US006500031B2

(12) United States Patent
Morita et al.

(10) Patent No.: US 6,500,031 B2
(45) Date of Patent: Dec. 31, 2002

(54) RETAINER-INCLUDING INSULATION DISPLACEMENT CONNECTOR

(75) Inventors: Makoto Morita, Osaka (JP); Yusuke Hamada, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/153,900

(22) Filed: May 24, 2002

(65) Prior Publication Data

US 2002/0137403 A1 Sep. 26, 2002

Related U.S. Application Data

(62) Division of application No. 09/819,855, filed on Mar. 29, 2001.

(30) Foreign Application Priority Data

Mar. 30, 2000 (JP) ..... 2000-095965

(51) Int. Cl.[7] ..... H01R 13/514
(52) U.S. Cl. ..... 439/752; 439/595
(58) Field of Search ..... 437/595, 752

(56) References Cited

U.S. PATENT DOCUMENTS

| | | | | | |
|---|---|---|---|---|---|
| 4,820,198 | A | * | 4/1989 | Lulko et al. | 439/595 |
| 5,026,304 | A | * | 6/1991 | Furrow | 439/595 |
| 5,647,775 | A | * | 7/1997 | Polgar et al. | 439/752 |
| 5,697,819 | A | * | 12/1997 | Hatagishi | 439/752 |
| 6,176,740 | B1 | * | 1/2001 | Abe et al. | 439/596 |
| 6,183,299 | B1 | * | 2/2001 | Ward et al. | 439/595 |
| 6,319,074 | B1 | * | 11/2001 | Kashiyama | 439/752 |

* cited by examiner

*Primary Examiner*—Gary Paumen
*Assistant Examiner*—James R. Harvey
(74) *Attorney, Agent, or Firm*—Oblon, Spivak, McClelland, Maier & Neustadt, P.C.

(57) ABSTRACT

In an insulation displacement connector including a retainer, a turn-down portion of a retainer is fit to hood portions provided at an end of an outer wall having electric wire insertion holes opened in a connector housing. Contacts are pressed by an inner portion of the turn-down portion. The connector housing is held by holding portions which continue to opposite sides of the turn-down portion. Further, the holding portions are engaged with the connector housing against a direction of drawing-out the contacts.

3 Claims, 13 Drawing Sheets

RETAINER-INCLUDING INSULATION DISPLACEMENT CONNECTOR

BACKGROUND OF THE INVENTION

1. Field of the Invention

The present invention is directed to the technical field of an insulation displacement connector having contacts for fitting cores of electric wires with insulation displacement, and particularly relates to an insulation displacement connector which is provided with a retainer for retaining contacts so that the contacts are prevented from dropping out from the connector housing when the contacts are subjected to a drawing-out force or compressive force from the electric wires. Here, the drawing-out force means a force mainly containing a force acting in the longitudinal direction of the contacts and in a direction of drawing the contacts out from the connector housing, and the compressive force means a force mainly containing a force acting in a direction perpendicular to the longitudinal direction of the contacts.

2. Description of the Related Art

Conventionally, a crimped style connector having contacts for crimping cores of electric wires has been used widely. The crimp style connector has a box-like connector housing, and contacts received in cavities piercing the connector housing. The work needed for crimping electric wires to the crimp style connector is carried out by the steps of: overlapping end cores of electric wires with end portions of the contacts; caulking a barrel on the cores while plastically deforming the barrel by a crimping tool; and inserting the contacts including an electric wire one by one into the cavities of the connector housing. There has been proposed a retainer for retaining contacts so that the contacts are prevented from being dislodged from the connector housing when the contacts undergo a drawing-out force from the electric wires. The retainer has stopper portions for being inserted into the cavities to press the contacts, and engaging portions to be engaged with the connector housing. Hence, the contacts are pressed by the stopper portions, and the contacts are prevented from dropping out from the cavities even in the case where draw-out force from the cavities acts on the contacts.

An insulation displacement connector having contacts for fitting cores of electric wires with insulation displacement has been used widely. In the condition that all the contacts are inserted into a connector housing, all the electric wires are simultaneously forced into slots of the contacts by an insulation displacement machine, so that the insulation displacement of the electric wires to the insulation displacement connector is performed. Hence, the number of steps can be reduced compared with the work required for crimping electric wires to form a crimped style connector. Hence, the machining cost can be reduced. Moreover, shortening of the time of delivery of such a connector including an electric wire can be achieved. This difference is remarkable in a multi-pole connector in which a large number of contacts are incorporated in one connector.

If the aforementioned retainer for a crimped style connector is applied to the insulation displacement connector, the contacts cannot be prevented from becoming dislodged. This is because there is a risk that the contacts may be removed from the cavities or the electric wires may be removed from the slots of the contacts when a compression force from the electric wires acts on the contacts in the direction of opening the electric wire insertion holes. This risk occurs because the electric wire insertion holes communicating with the slots of the contacts are opened up to the inlets of the cavities in an outer wall of the connector housing of the insulation displacement connector.

SUMMARY OF THE INVENTION

The present invention is designed bearing in mind this respect and an object of thereof is to provide an insulation displacement connector including a retainer in which: a turned-down portion of a retainer is fitted to hood portions, including opened electric wire insertion holes, provided at an end of an outer wall of a connector housing to thereby press contacts against the end of the outer wall. The connector housing is held by holding portions continuing to opposite sides of the turned-down portion and the holding portions are engaged with the connector housing against a direction of drawing-out of the contacts to thereby prevent the contacts from dropping out from the connector housing when the contacts undergo a drawing-out force or a compression force from the electric wires.

In order to achieve the above object, the insulation displacement connector including the retainer according to a first aspect of the invention has a feature that the insulation displacement connector comprises: male or female contacts each having a connection portion and slots, the connection portion being provided at a front end so as to be brought into contact with a partner contact under the assumption that a lengthwise direction is regarded as a front-rear direction, the slots being disposed on a side more rearwardly located than the connection portion and being opened in a heightwise direction perpendicular to the front-rear direction, the slots being provided for fitting a core, at a front end, of a corresponding electric wire inserted from the heightwise direction; a connector housing including cavities, hood portions and electric wire insertion holes, the cavities being formed so as to pierce the connector housing in the front-rear direction and being provided for receiving the contacts, the hood portions being disposed at one end in the heightwise direction and being formed to protrude rearward from a rear end of an outer wall on the side where the slots are opened, the electric wire insertion holes being opened in the outer wall in an area ranging from portions corresponding to the slots to rear ends of the hood portions respectively; and a retainer including a turned-down portion, a pair of holding portions and a pair of engaging portions, the turned-down portion being U-shaped so that a section which is cut by a plane facing a widthwise direction strides over the hood portions based on an assumption that a direction perpendicular to the front-rear direction and to the heightwise direction is regarded as the widthwise direction, the turned-down portion being fitted to the hood portions and extending in the widthwise direction so that a front end of an inner portion located in the inside of the hood portions presses the contacts from a back side, the pair of holding portions being provided at opposite ends, in the widthwise direction, of the turned-down portion and being bent like an L figure and an inverted L figure when viewed from a front-back direction so as to hold opposite end portions, in the widthwise direction, of the connector housing, the pair of engaging portions extending frontwardly from the holding portions respectively so as to be engaged with the connector housing.

First, when contacts are received in the connector housing without any retainer attached, front ends of electric wires are inserted through electric wire insertion holes and fit to slots of the contacts with insulation displacement. Then, a retainer is attached to the connector housing. That is, the turned-down portion of the retainer is fitted to the hood portions of the connector housing, widthwise opposite end portions of the connector housing are held by the holding portions, and the engaging portions are engaged with the connector housing. In such a manner, because the front end of the inner portion of the turned-down portion presses the contacts from the rear side, the contacts never become dislodged from the connector housing even in the case where the contacts suffer draw-out force from the electric wires. Moreover, even in the case where the contacts suffer compressive force from the electric wires in a direction toward the opened electric wire insertion holes, that is, in one heightwise direction, the turned-down portion receives this force, the hood portions fitted to the turned-down portion next receive this force, and the connector housing last receives this force through the holding portions. Hence, there is little force acting on the contacts so that the contacts can be prevented from becoming dislodged from the connector housing.

The insulation displacement connector including the retainer according to a second aspect of the invention has a feature wherein in the configuration stated in the first aspect of the invention, an outer portion of the turned-down portion is shaped like a plate parallel to the outer wall of the connector housing and extends frontward so as to cover the electric wire insertion holes.

In such a manner, external appearance becomes fine and elegant because the contacts and the insulation displacement portions are covered with the outer portion of the turn-down portion. Moreover, safety is improved because contact with a conductor can be prevented when the conductor is present in the periphery.

The insulation displacement connector including the retainer according to a third aspect of the invention has a feature that in the configuration stated in the first or second aspect of the invention, each of the holding portions has a vertical wall and a horizontal wall, the vertical wall extending in the heightwise direction toward an outer wall opposite to the outer wall having the electric wire insertion holes opened, the horizontal wall extending in the widthwise direction from an end of a vertical wall toward a vertical wall of the other holding portion; each of the engaging portions is provided so as to continue to a front side of the vertical wall and has a hook provided at its front end so as to be bent toward a heightwise direction or toward the widthwise direction; rails extending in the front-rear direction are provided in respective end portions, in the widthwise direction, of the connector housing; and engaged portions hooked by the hooks are provided at front ends of the rails or near the front ends of the rails in the connector housing.

In such a manner, when the retainer is to be attached to the connector housing, the engaging portions are brought into contact with the rails and moved forward, and the engaged portions are hooked by the hooks. In this condition, the rails are received by the horizontal walls of the holding portions.

The insulation displacement connector including the retainer according to a fourth aspect of the invention has a feature that in the configuration stated in any one of the first to third aspect of the invention, the insulation displacement connector including the retainer further comprises a holding mechanism for holding the contacts in the connector housing.

In such a manner, because the contacts are held in the connector housing by the holding mechanism, the contacts can be primarily prevented from becoming dislodged from the connector housing even in the case where the contacts are subjected to drawing-out force or a compression force from the electric wires. Moreover, because the contacts are more intensively retained in the connector housing by the retainer, the contacts can be prevented from becoming dislodged from the connector housing even in the case where more intensive draw-out force or compressive force from the electric wires is received.

BRIEF DESCRIPTION OF THE DRAWINGS

FIG. 4(*b*) is a sectional view taken along the line B—B in FIG. 2.

FIG. 7(*a*) being a view from an electric wire insertion hole, showing one contact in the condition that an outer wall corresponding to the contact is cut off and FIG. 7(*b*) being a longitudinal sectional view of FIG. 7(*a*).

FIG. 8(*a*) being a side view, FIG. 8(*b*) being a plan view, and FIG. 8(*c*) being a view from the rear end.

FIG. 9(*a*) being a front view and FIG. 9(*b*) being a longitudinal sectional view.

FIG. 13(*a*) being a perspective view of a retainer to be attached to a crimp style connector and FIG. 13(*b*) being a longitudinal sectional view of the crimp style connector with the retainer attached thereto.

DETAILED DESCRIPTION OF THE PREFERRED EMBODIMENTS

Embodiments of an insulation displacement connector including a retainer according to the present invention will be described below. FIGS. 1 to 7 show an insulation displacement connector 100 including a retainer according to a first embodiment. Although here is shown a six-pole insulation displacement connector 100 as an example, the number of poles in the insulation displacement connector according to the present invention is not limited thereto but can be selected at option. Electric wires 300 of the number corresponding to the number of poles are connected to the insulation displacement connector 100. The insulation displacement connector 100 is connected to a partner connector 200. Although a base connector to be mounted on a printed wiring board is illustrated as the partner connector 200 here, the type of the partner connector to be coupled with the insulation displacement connector according to the present invention is not limited thereto. For example, the partner connector may be a connector having electric wires mounted thereon.

Figure 8A:
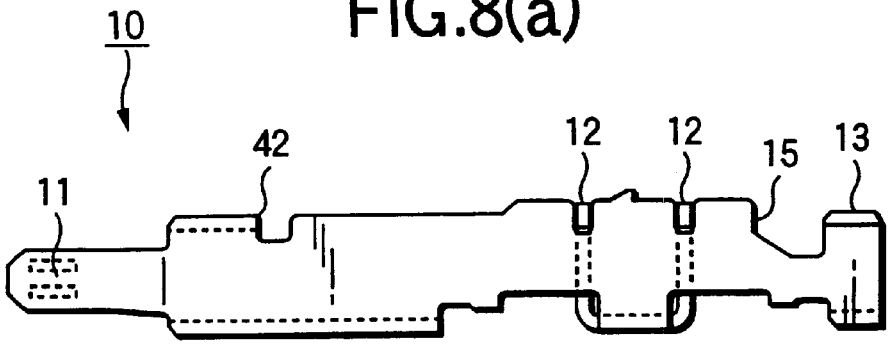
FIGS. 8(*a*) and (*b*) show a contact in the insulation displacement connector including the retainer.
Figure 8B:
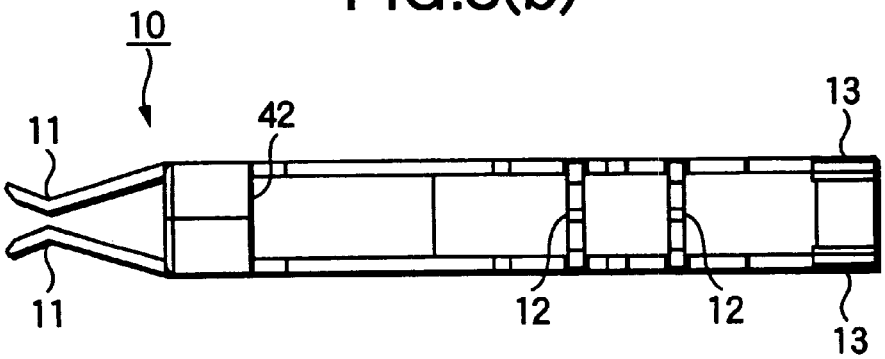
Figure 8C:
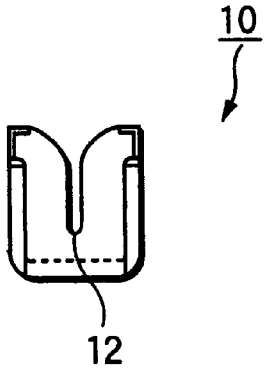

In these drawings, reference numeral 10 designates each insulation displacement contact and 20 denotes a connector housing in which the contact 10 is inserted. FIG. 8 shows the contact 10. Now, directions are defined below for the sake of convenience of description. Assuming that the longitudinal direction of the contact 10 is a front-rear direction, a direction perpendicular to the front-rear direction is a heightwise direction, and a direction perpendicular both to the front-rear direction and to the heightwise direction is a widthwise direction. This direction definition will be also applied to the description of other members. Incidentally, the direction definition has no relation with the direction in which the insulation displacement connector is used. As shown in FIG. 8, a connection portion 11 which comes into contact with a corresponding contact 210 of the partner connector 200 is provided at a front end of the contact 10. In this embodiment, the connection portion 11 is shaped like a recess for receiving a connection portion of a male type partner contact 210 because the contact 10 is of a female type. If the contact 10 is of a male type, conversely, the connection portion 11 will be shaped like a protrusion for running into a corresponding connection portion of a female type partner contact 210. Slots 12 which are opened toward one heightwise direction and which are provided for fitting a core at a front end of a corresponding electric wire 300 inserted from this direction are provided in the contact 10 on the side more rear than the connection portion 11. As shown in FIG. 8, a plate-like member positioned in the front-rear direction is grooved from one heightwise direction to thereby form the slots 12. Although here is shown the case where two slots 12 are provided in one contact 10, the number of slots can be selected at option. Further, an insulation barrel 13 is provided at the rear end of the contact 10 as occasion demands. The insulation barrel 13 is crimped with an electrically insulating coating of the electric wire 300 so that the power of the contact 10 for holding the electric wire 300 is increased.

As shown in FIGS. 1 to 7, the connector housing 20 is shaped substantially like a rectangular parallelepiped. The connector housing 20 has a first outer wall 21 at one end in the heightwise direction, a second outer wall 22 at the other end in the heightwise direction, a front wall 23 in the front, and a rear wall 24 in the rear. In the connector housing 20, cavities 25 are provided to pierce the connector housing 20 in the front-rear direction so that the cavities 25 receive the contacts 10. Openings of the cavities 25 formed in the front wall 23 serve as insertion holes for inserting male contacts respectively. In this embodiment, the cavities 25 receive the partner contacts 210 through the insertion holes. Openings of the cavities 25 formed in the rear wall 24 serve as drawer holes for drawing out the electric wires 300, respectively.

In the connector housing 20, hood portions 26 protrude toward the rear are formed at a rear end of the first outer wall 21 which is located at one end in the heightwise direction and which is in the direction of opening of the slots 12. Further, electric wire insertion holes 27 ranging from portions corresponding to the slots 12 to the rear ends of the hood portions 26, respectively, are opened in the first outer wall 21.

Figure 1:
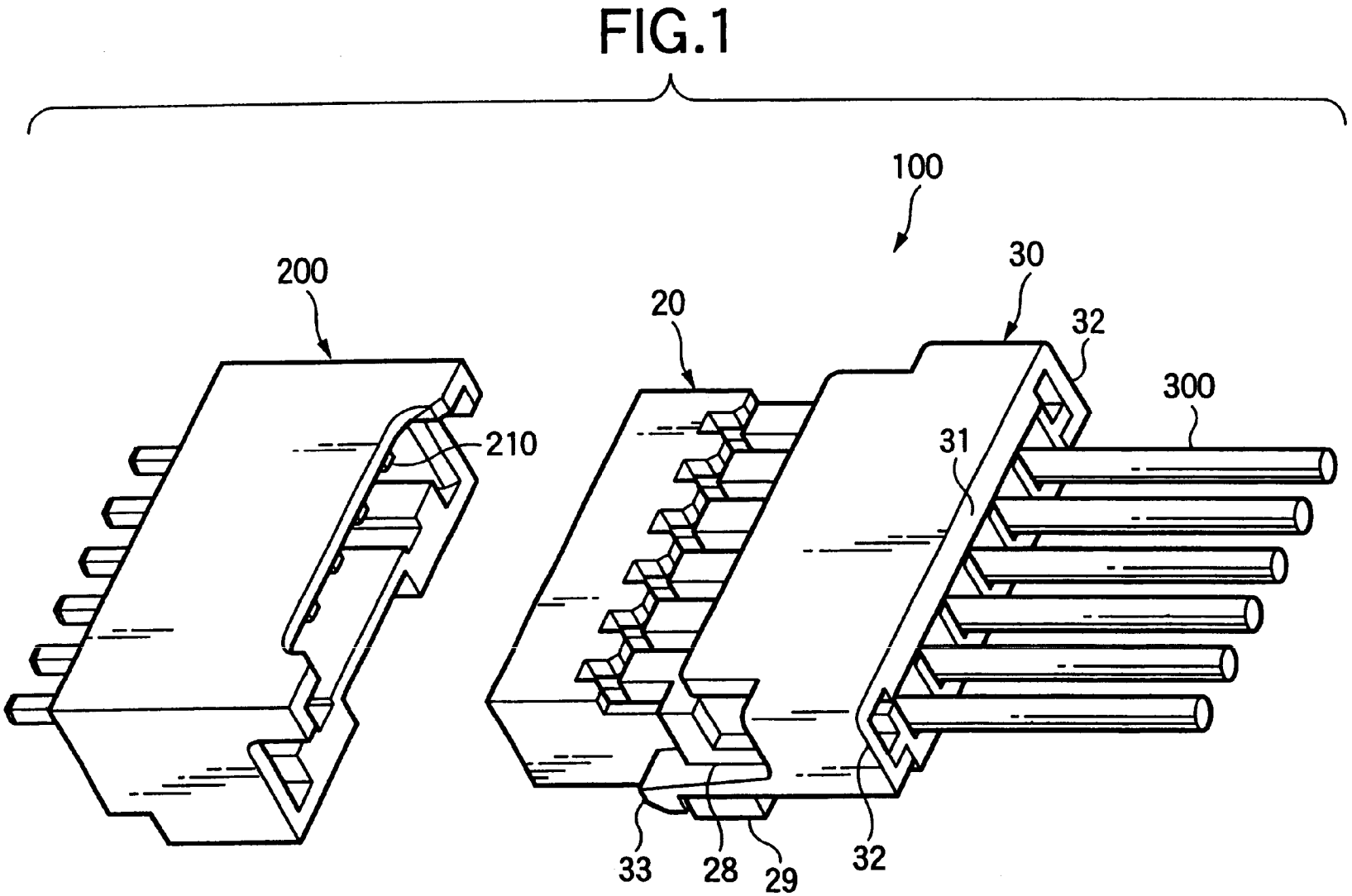
FIG. 1 is a perspective view showing an insulation displacement connector including a retainer according to a first embodiment together with a partner connector.
Figure 2:
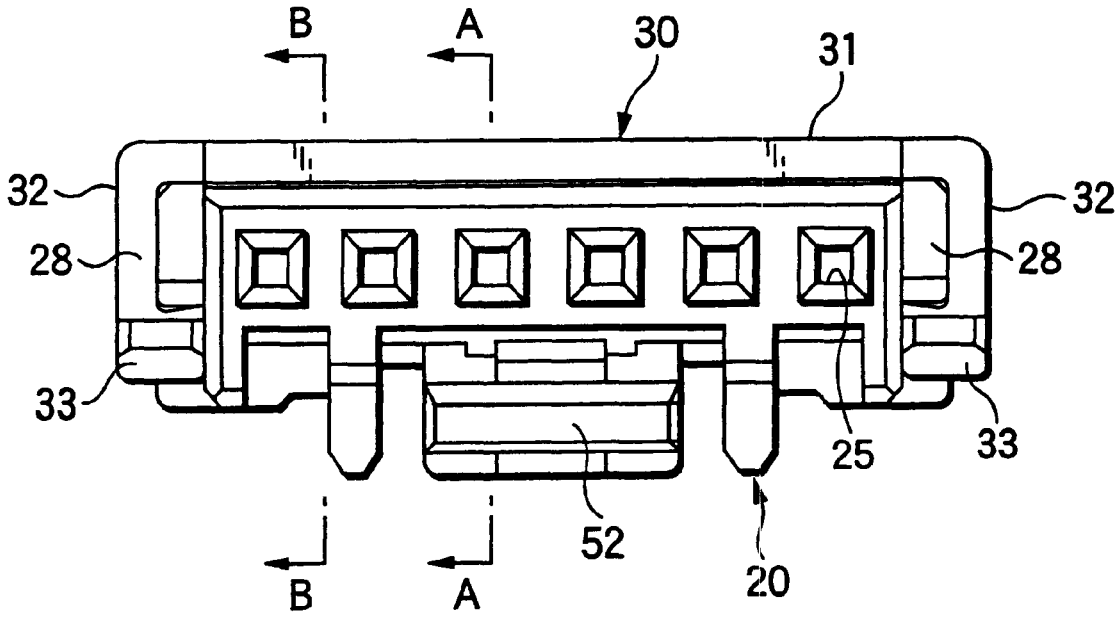
FIG. 2 is a front view of the insulation displacement connector including the retainer.
Figure 3:
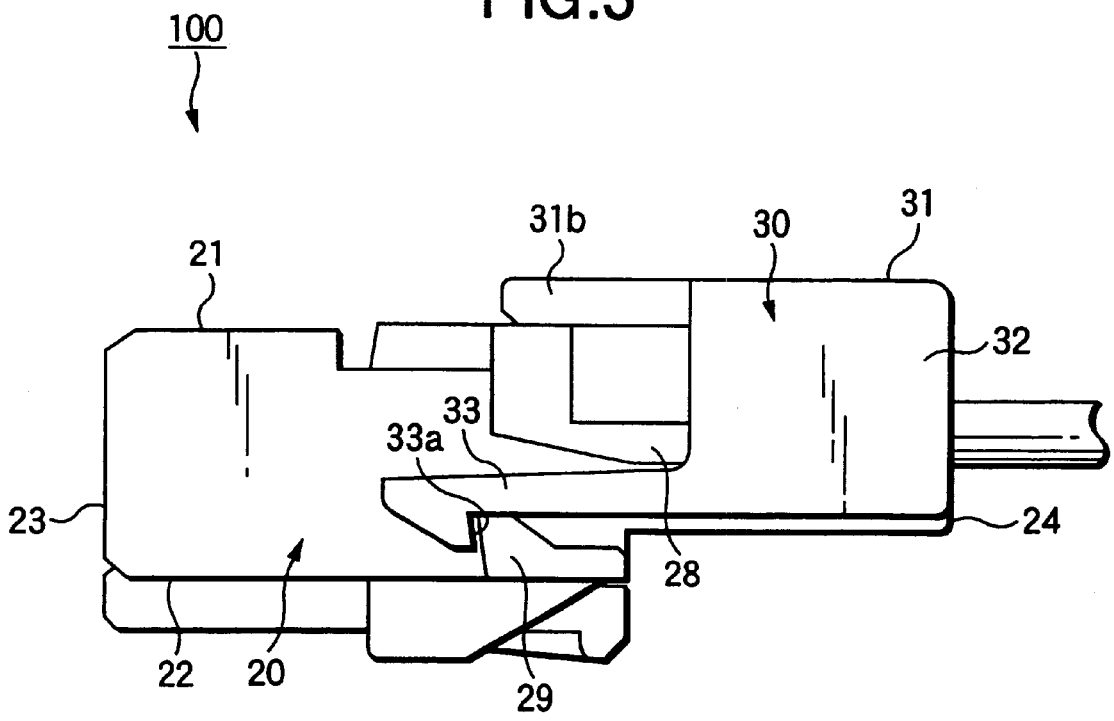
FIG. 3 is a side view of the insulation displacement connector including the retainer.
Figure 4A:
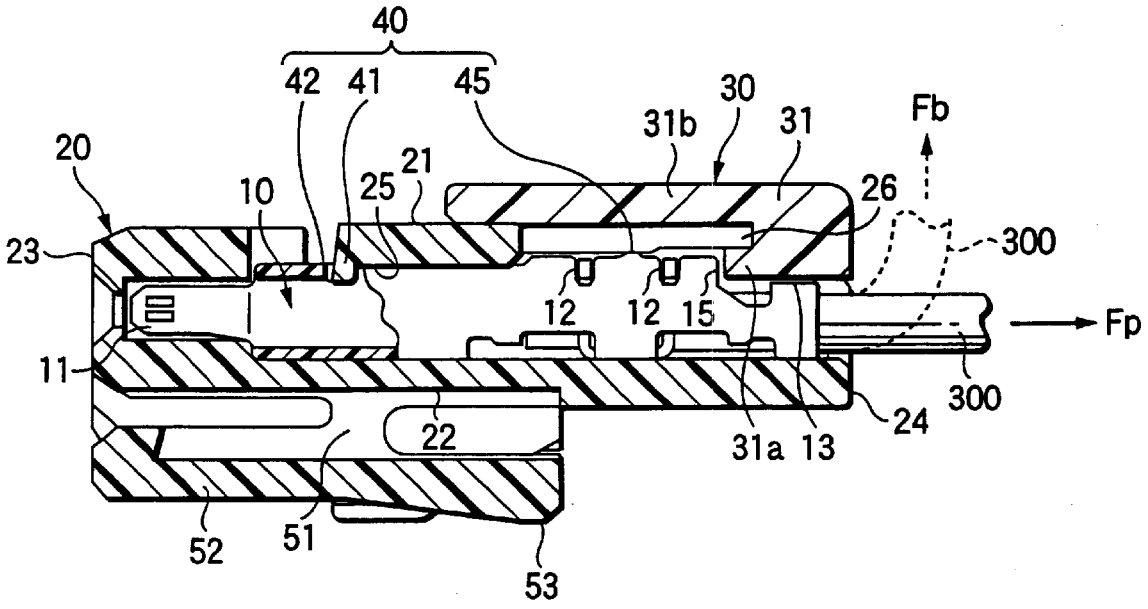
FIG. 4(*a*) is a sectional view taken along the line A—A in FIG. 2.
Figure 4B:
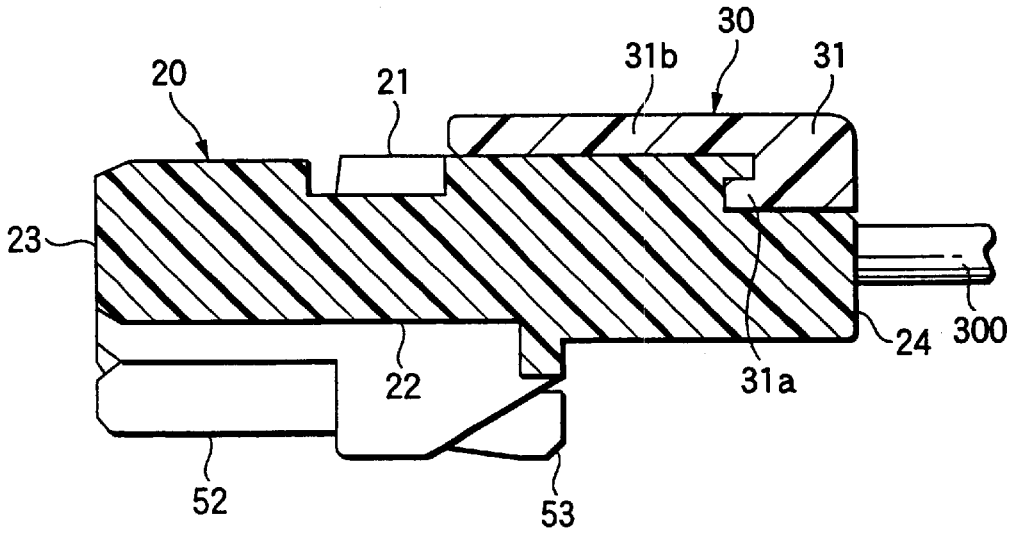
Figure 5:
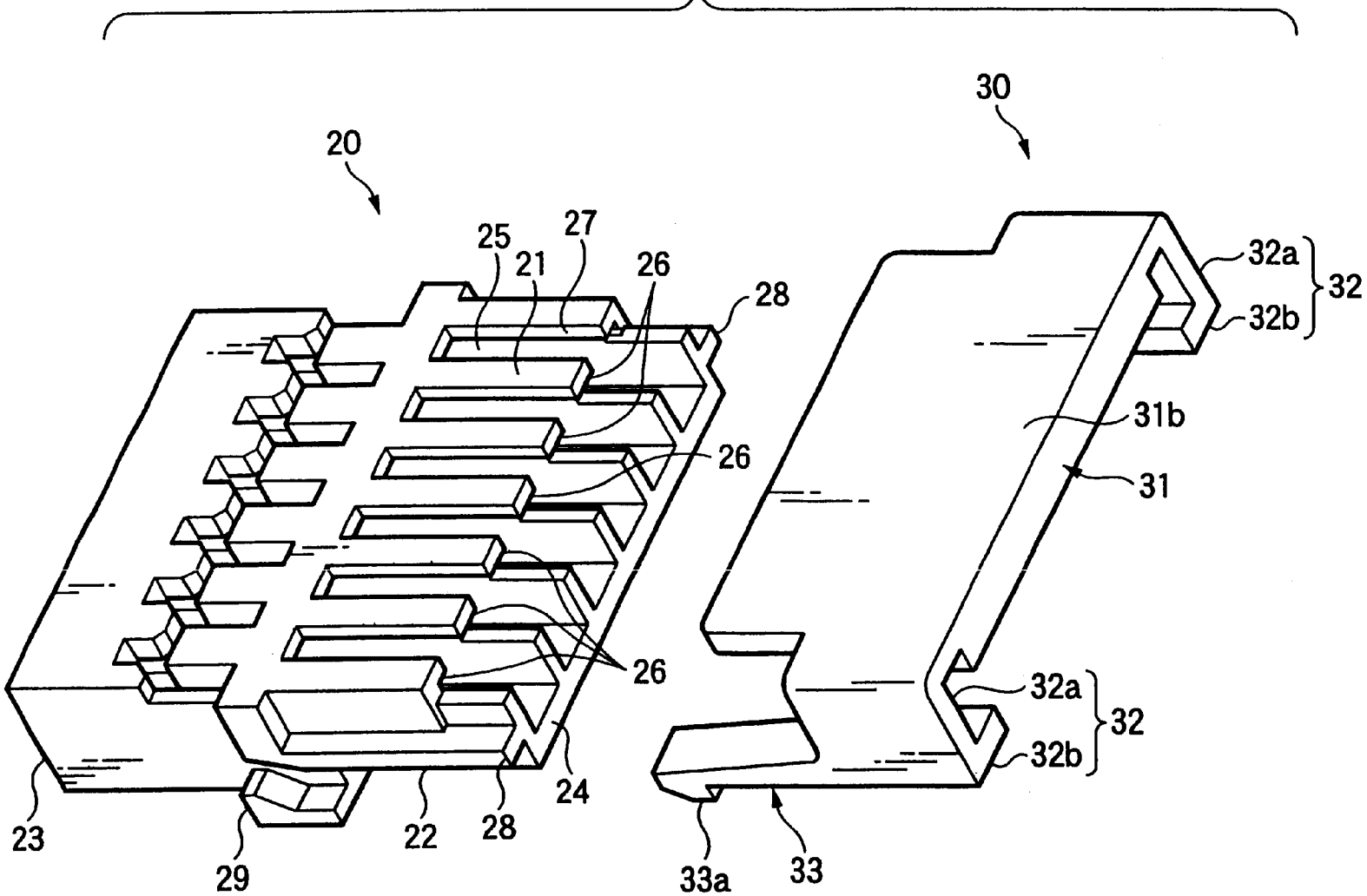
FIG. 5 is an exploded perspective view of a retainer and a connector housing in the insulation displacement connector including the retainer.
Figure 6:
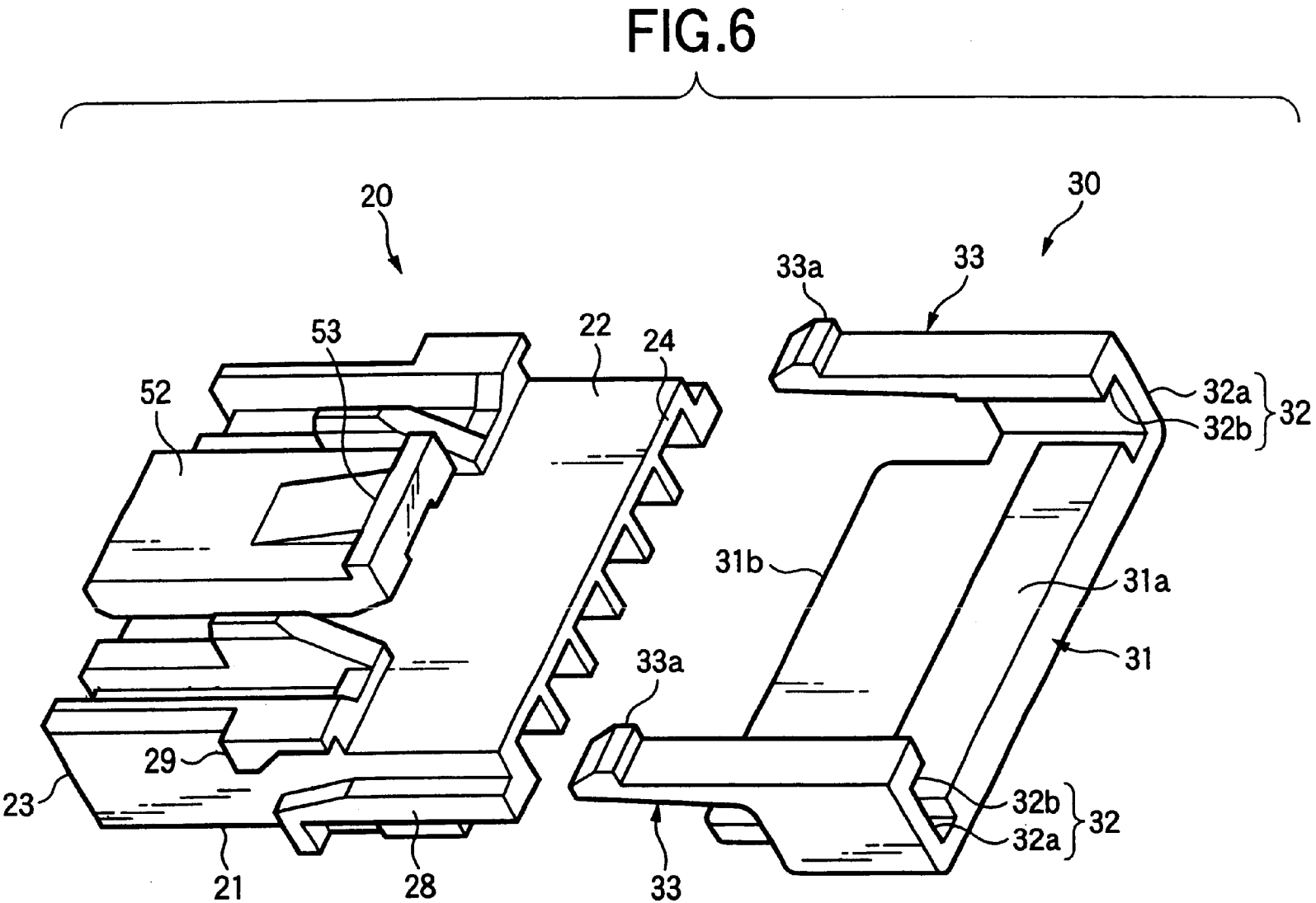
FIG. 6 is an exploded perspective view of the retainer and the connector housing in the insulation displacement connector including the retainer from another angle.
Figure 7A:
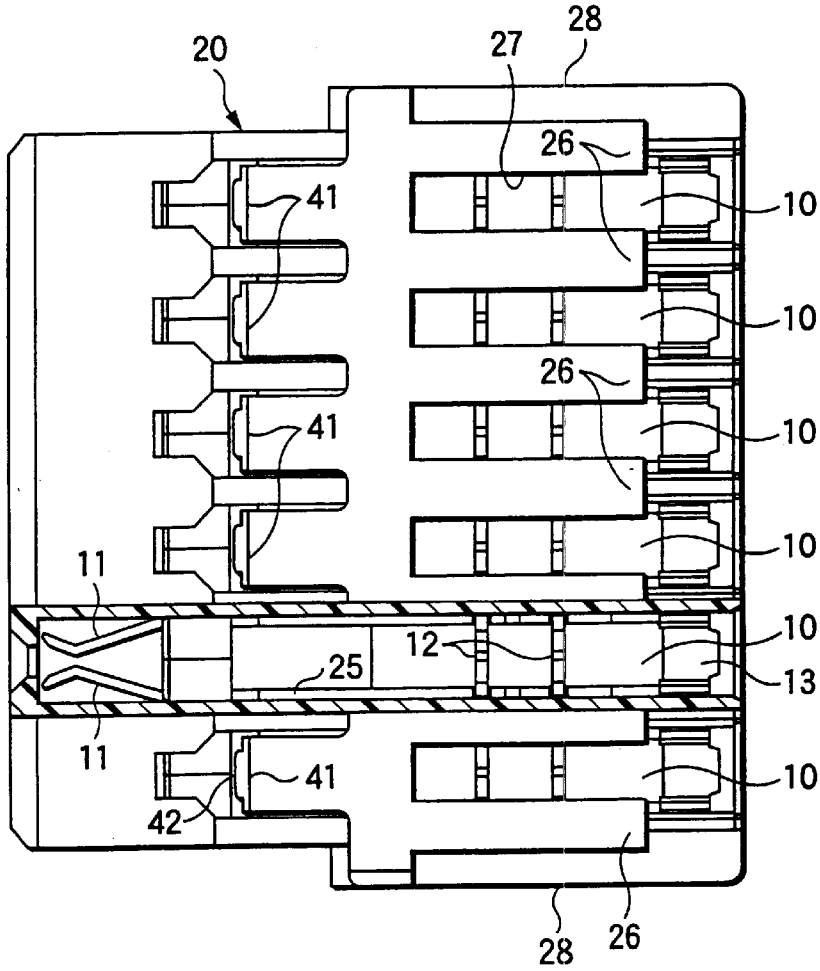
FIGS. 7(*a*) and (*b*) are views of the insulation displacement connector including the retainer in the case where the retainer is removed.
Figure 7B:
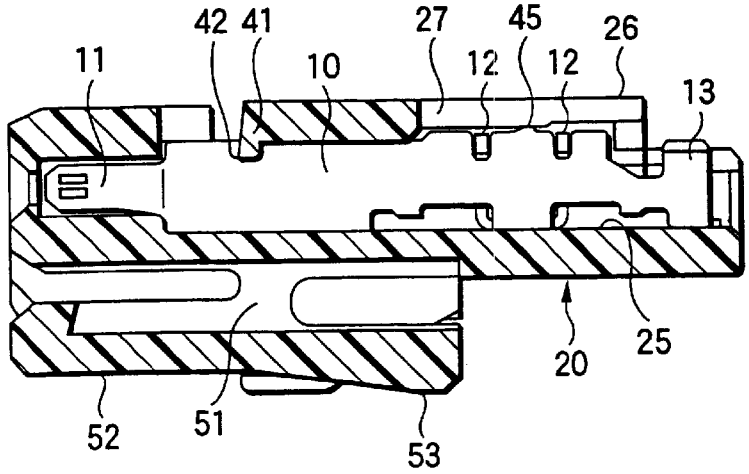
Figure 9A:
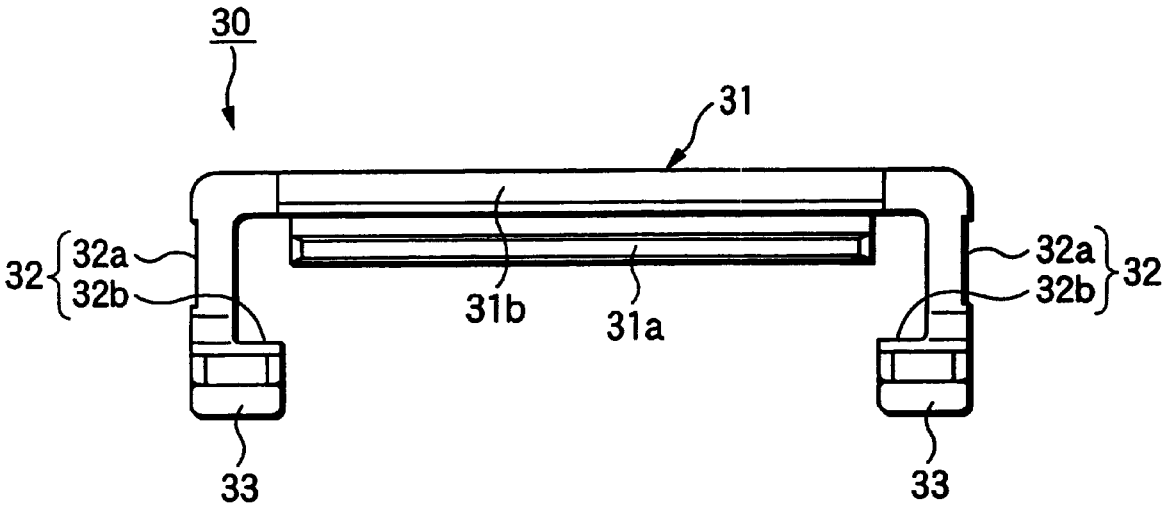
FIGS. 9(*a*) and (*b*) show the retainer in the insulation displacement connector including the retainer.
Figure 9B:
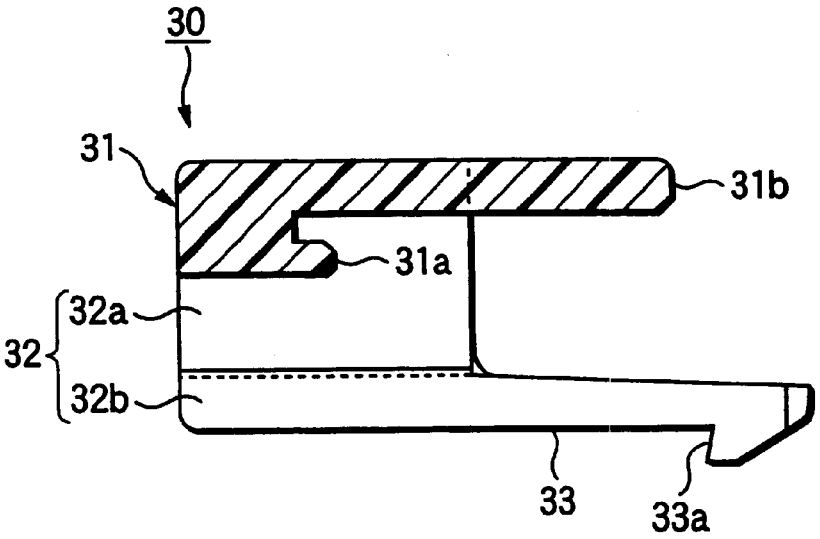

A retainer 30 is attached to the connector housing 20. As shown in FIG. 9, the retainer 30 has a turned-down portion 31, a pair of holding portions 32, and a pair of engaging portions 33. As shown in FIGS. 4 and 9(*b*), the turned-down portion 31 is formed so that a section cut by a plane facing the widthwise direction is U-shaped so as to stride over the hood portions 26. More particularly in the direction of these drawings, the section is U-shaped laterally. Hence, the turned-down portion 31 is fitted to the hood portions 26. The turned-down portion 31 extends in the widthwise direction. As shown in FIG. 4(*a*), in the turned-down portion 31, a front end of an inner portion 31 a located in the inside of the hood portions 26 abuts on the contacts 10 from the rear to thereby press the contacts 10 from the rear side. In this embodiment, a comer portion 15 having a rear end surface cut in the heightwise direction is formed in each contact 10. A front end of the inner portion 31*a* abuts the rear end surface of the comer portion 15. The pair of holding portions 32 are provided at widthwise opposite ends of the turned-down portion 31. The first holding portion 32 is bent like an L figure when viewed from the front-rear direction so that the first holding portion 32 holds one widthwise end portion of the connector housing 20. The second holding portion 32 is bent like an inverted L figure in the front-rear direction so that the second holding portion 32 holds the other widthwise end portion of the connector housing 20. The engaging portions 33 extend frontward from the holding portions 32 respectively so as to be engaged with the connector housing.

An outer portion 31*b* of the turn-down portion 31 is shaped like a plate parallel to the first outer wall 21 of the connector housing 20. The outer portion 31*b* extends frontward so as to cover the electric wire insertion holes 27.

Each of the holding portions 32 has a vertical wall 32*a* and a horizontal wall 32*b*. The vertical wall 32*a* extends in the heightwise direction toward the second outer wall 22 opposite to the first outer wall 21 which has the electric wire insertion holes 27 opened, while the horizontal wall 32*b* extends in the widthwise direction from an end of the vertical wall 32*a* toward the vertical wall 32*a* of the other holding portion 32. The engaging portions 33 are provided so as to continue to the front sides of the horizontal walls 32*b* respectively. Hooks 33*a* are provided at front ends of the engaging portions 33 respectively. Each of the hooks 33*a* is bent in a direction in which its end becomes spaced from the first outer wall 21, which has the electric wire insertion holes 27 opened, in a heightwise direction. A rail 28 extending in the front-rear direction is provided in each of widthwise end portions of the connector housing 20. An engaged portion 29 made of a protrusion hooked by the corresponding hook 33*a* is provided near a front end of each of the rails 28 in the connector housing 20.

As shown in FIG. 4(*a*), the insulation displacement connector 100 has a holding mechanism 40 for holding each contact 10 in the connector housing 20. The holding mechanism may include a contact lance mechanism, a housing lance mechanism and a pressing mechanism. These mechanisms may be combined suitably. In this embodiment, the holding mechanism 40 is constituted by a housing lance mechanism. That is, a protrusion is formed on the inner wall surface of the cavity 25 of the connector housing 20 so that the protrusion serves as a lance 41. A lock portion for locking the lance 41 is correspondingly formed in the contact 10. Here, a bottom wall 42 formed in the front portion of the contact 10 serves as the lock portion. When the contact 10 is inserted into the cavity 25, the bottom wall 42 pushes down the lance 41 by its flexibility to ride over the lance so as to enter a portion in front of the lance 41. The rear end of the bottom wall 42 is caught in the lance 41 to thereby prevent the contact 10 from becoming dislodged from the cavity 25. Incidentally, the contact lance mechanism has a lance which is a protrusion formed on the outer wall surface of the contact, and a lock portion which is formed on the inner wall surface of the cavity of the connector housing to thereby lock the lance. The press-in mechanism is a mechanism in which the outer wall surface of the contact and the inner wall surface of the cavity are partially formed with a tight-fitting size so that the contact is forced into the cavity and held in the cavity.

As shown in FIGS. 4(*a*), 7 and 8, in the insulation displacement connector 100, the holding mechanism 40 further has a press-in mechanism. That is, a press-in protrusion 45 is formed on the outer wall of the contact 10. Concentrated contact force acts between the press-in protrusion 45 and the inner wall of the cavity 25 to thereby hold the contact 10 in the cavity 25. The press-in is performed when the contact 10 is inserted in the cavity 25.

As shown in FIGS. 4(*a*) and 6, a so-called outer lock type locking mechanism is provided in the insulation displacement connector 100. More particularly, the insulation displacement connector 100 has a support portion 51, an arm 52, and a gripping portion 53. The support portion 51 is formed so as to protrude outward from the second outer wall 22 formed at one end, in the heightwise direction, of the connector housing 20. The arm 52 extends frontward from the support portion 51 and has a hook to be engaged with the partner connector 200. The gripping portion 53 extends backward from the rear end of the arm 52.

Figure 13A:
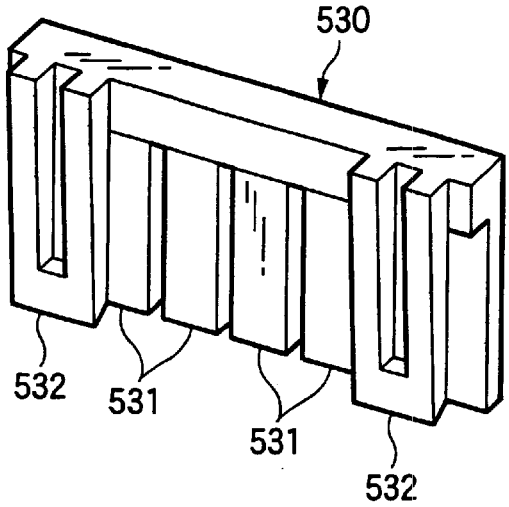
FIGS. 13(*a*) and (*b*) show a comparative example.
Figure 13B:
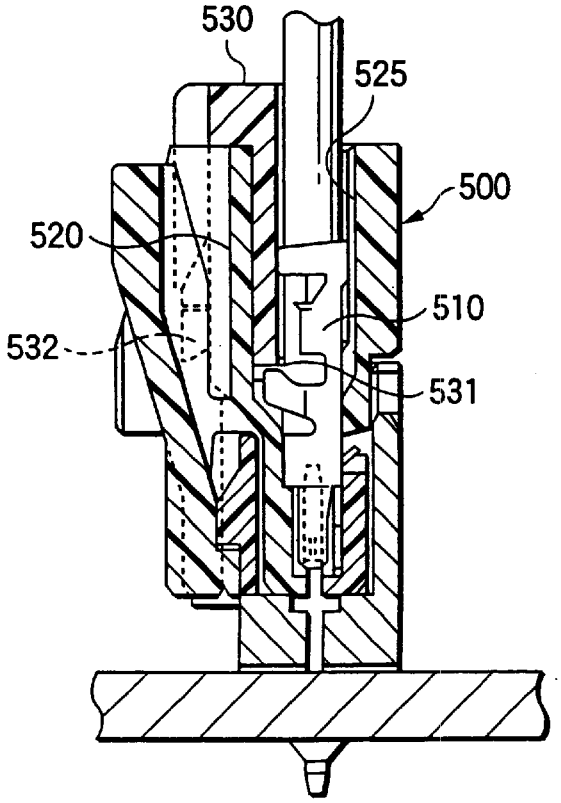

Next, the operation and effect of the first embodiment will be described. First, a retainer 530 to be attached to a crimp style connector 500 as a comparative example shown in FIG. 13 has stopper portions 531 which are inserted into cavities 525 of a connector housing 520 to thereby press contacts 510, and engaging portions 532 which are engaged with the connector housing 520. Because the contacts 510 are designed to be pressed by the stopper portions 531, the contacts 510 can be prevented from becoming dislodged from the cavities 525 even in the case where draw-out force from the cavities 525 acts on the contacts 510. If the retainer 530 is merely applied to a insulation displacement connector, there is a risk that the contacts may be removed from the cavities or the electric wires may be removed from the slots of the contacts when the contacts suffer compass force from the electric wires in a direction toward the opened electric wire insertion holes. Such a problem can be solved by the insulation displacement connector 100 including the retainer according to the first embodiment. The procedure of connecting the electric wires 300 to the insulation displacement connector 100 will now be described. In the condition that the contacts 10 are received in the connector housing 20 without any retainer 30 attached, front ends of the electric wires 300 are inserted through the electric wire insertion holes 27 and fit to the slots 12 of the contacts 10 with insulation displacement. Then, the retainer 30 is attached to the connector housing 20. That is, the turned-down portion 31 of the retainer 30 is fitted to the hood portions 26 of the connector housing 20, widthwise opposite end portions of the connector housing 20 are held in the holding portions 32, and the engaging portions 33 are engaged with the connector housing 20. In such a manner, even in the case where the contacts 10 undergoes a drawing-out force from the electric wires 300 as represented by the arrow Fp shown in FIG. 4(*a*), the contacts 10 never becomes dislodged from the connector housing 20 because the front end of the inner portion 31*a* of the turned-down portion 31 presses the contacts 10 from the rear side. Moreover, even in the case where the contacts 10 undergoes a compressive force from the electric wires 300 in a direction toward of the opened electric wire insertion holes 27 as represented by the arrow Fb shown in FIG. 4(*a*), there is little force acting on the contacts 10 because the turned-down portion 31 receives this force, the hood portions 26 to be fit to the turned-down portion 31 next receive this force, and the connector housing 20 last receives this force through the holding portions 32. Hence, the contacts 10 can be prevented from becoming dislodged from the connector housing 20.

The length, in the front-rear direction, of the turned-down portion of the retainer according to the present invention is not limited. However, as shown in the first embodiment, when the outer portion 31*b* of the turned-down portion 31 is shaped like a plate parallel to the first outer wall 21 of the connector housing 20 and extended frontward so as to cover the electric wire insertion holes 27, the following operation and effects are obtained. That is, the external appearance is attractive because the contacts 10 and the insulation displacement portions are covered with the outer portion 31*b* of the turned-down portion 31. Moreover, safety is improved because contact with a conductor can be prevented when the conductor is present in the periphery.

The present invention includes an embodiment in which the contact holding mechanism is not provided. However, when the holding mechanism for holding the contacts 10 in the connector housing 20 is provided as shown in the first embodiment, the following operation and effect are obtained. That is, because the contacts 10 are held by the holding mechanism in the connector housing 20, the contacts 10 can be primarily prevented from becoming dislodged from the connector housing 20 even in the case where the contacts 10 undergo a drawing-out force or a compressive force from the electric wires 300. Moreover, because the contacts 10 are retained in the connector housing 20 more intensively by the retainer 30, the contacts 10 can be prevented from becoming dislodged from the connector housing 20 even in the case where more intensive draw-out force or compressive force from the electric wires 300 is received.

Next, other embodiments will be described. Hereunder, parts fulfilling the same function as in the first embodiment are referenced correspondingly and the description thereof will be omitted.

Figure 10:
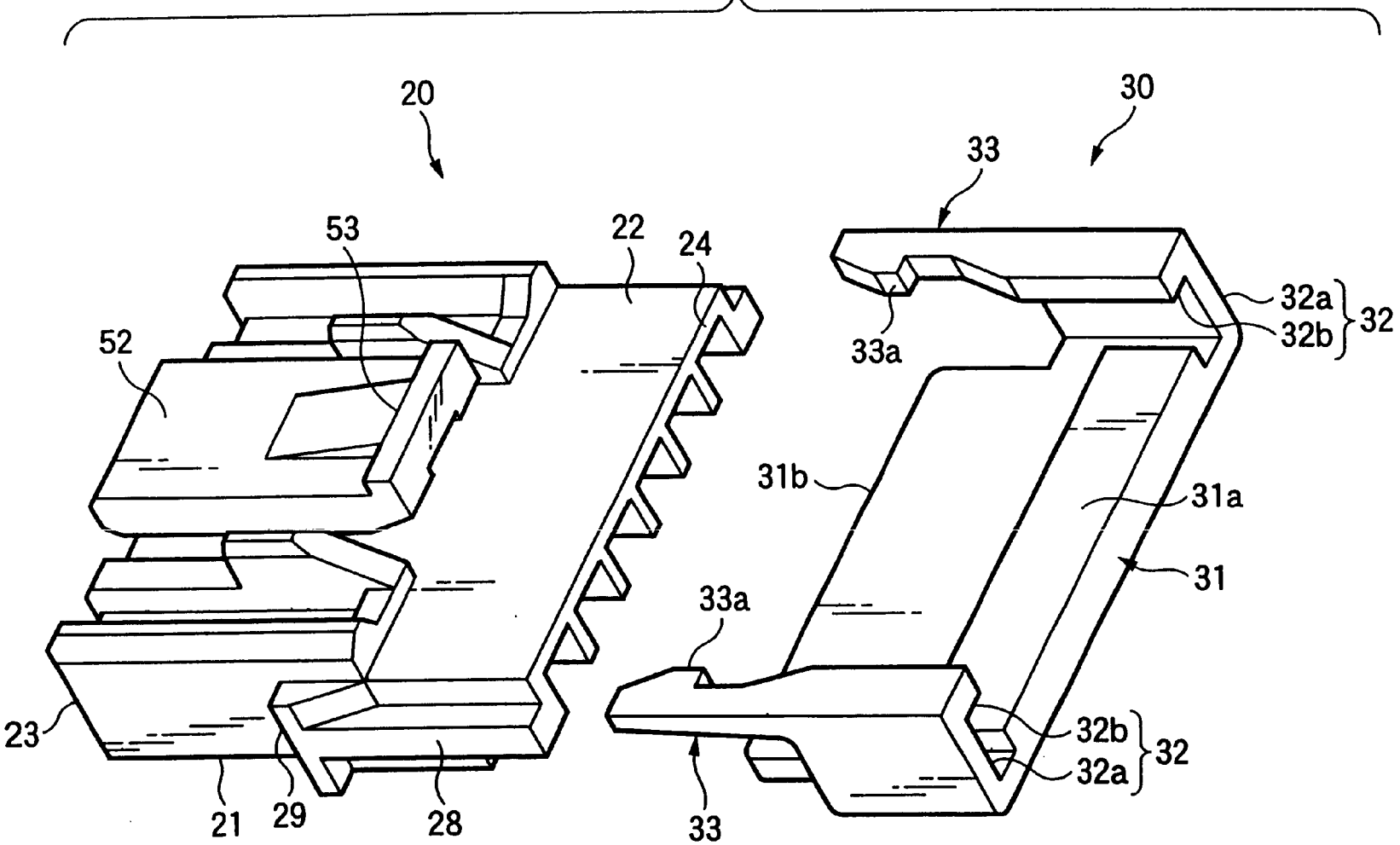
FIG. 10 is an exploded perspective view of the retainer and the connector housing in the insulation displacement connector including the retainer according to a second embodiment.

FIG. 10 shows a second embodiment. In the first embodiment, each of the hooks 33*a* of the engaging portions 33 has an end bent in a heightwise direction toward a direction of departing from the first outer wall 21 having the electric wire insertion holes 27 opened. On the other hand, in the second embodiment, each of the hooks 33*a* of the engaging portions 33 has an end bent inward in the widthwise direction. The engaged portions 29 made of protrusions are hooked by the hooks 33*a*, respectively, except that the configuration is the same as that in the first embodiment.

Figure 11:
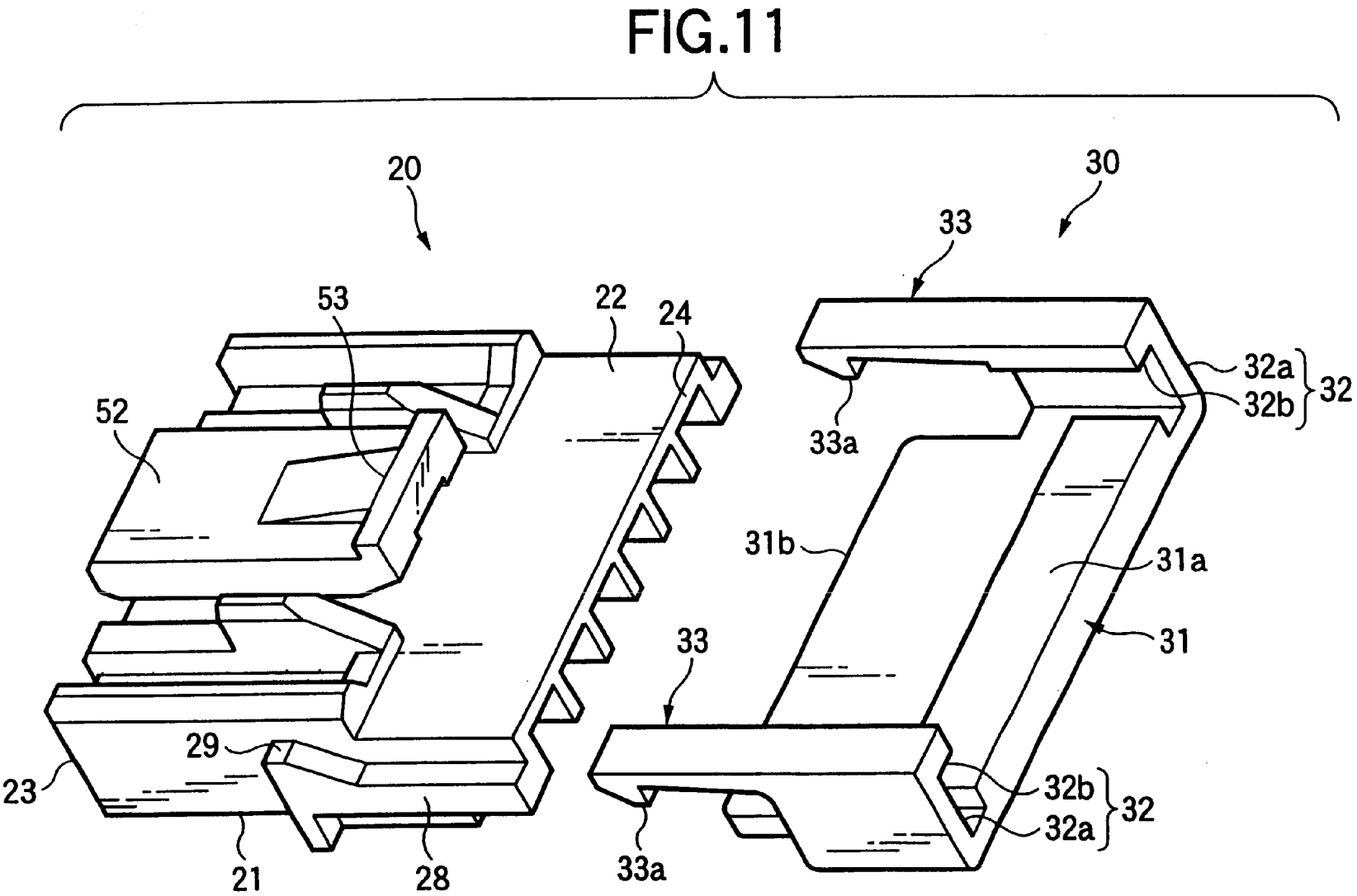
FIG. 11 is an exploded perspective view of the retainer and the connector housing in the insulation displacement connector including the retainer according to a third embodiment.

FIG. 11 shows a third embodiment. In the third embodiment, each of the hooks 33*a* of the engaging portions 33 has an end bent in a heightwise direction toward a direction of approaching the first outer wall 21 having the electric wire insertion holes 27 opened. The engaged portions 29 made of protrusions are hooked by the hooks 33*a* respectively. Except that, the configuration is the same as that in the first embodiment.

Figure 12:
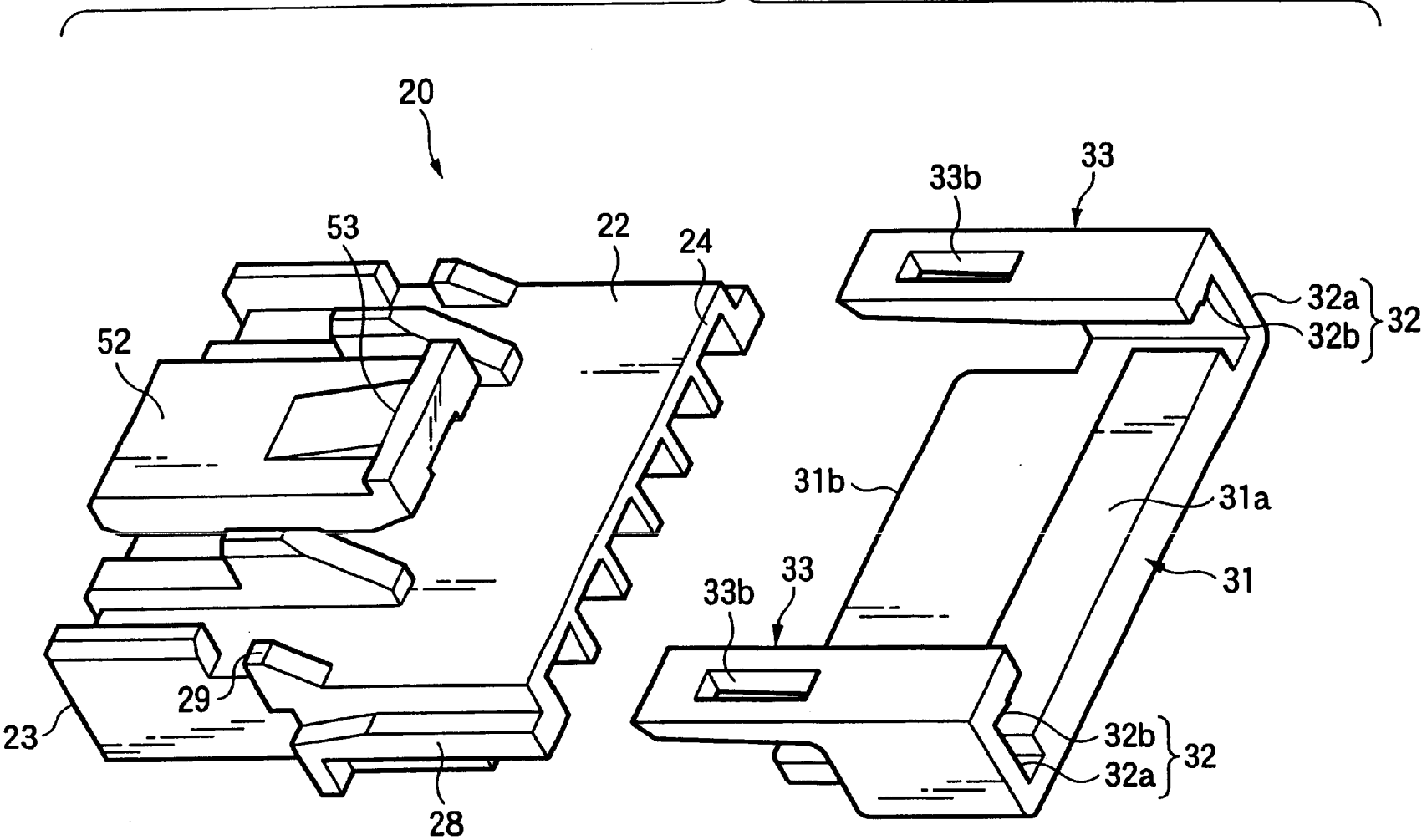
FIG. 12 is an exploded perspective view of the retainer and the connector housing in the insulation displacement connector including the retainer according to a fourth embodiment.

FIG. 12 shows a fourth embodiment. In the fourth embodiment, each of the holding portions of the retainer in the insulation displacement connector has a vertical wall 32*a* and a horizontal wall 32*b*. The vertical wall 32*a* extends in the heightwise direction toward the second outer wall 22 which is opposite to the first outer wall 21 having the electric wire insertion holes 27 opened, while the horizontal wall 32*b* extends in the widthwise direction from an end of the vertical wall 32*a* toward the vertical wall 32*a* of the other holding portion 32. The engaging portions 33 are provided to continue to the front side of the horizontal walls 32*b* respectively. The horizontal walls 32*b* are fit to the second outer wall 22 which is opposite to the first outer wall 21 having the electric wire insertion holes 27 opened. Further, engaged portions 29 formed as protrusions are provided on the second outer wall 22 to which the horizontal walls 32*b* are fitted. Fit portions 33*b* made of holes or through-holes for fitting the engaged portions 29 are formed in the engaging portions respectively, except that the configuration is the same as that in the first embodiment. In such a manner, when the retainer is to be attached to the connector housing 20, the engaging portions 33 are brought into contact with the second outer wall 22 opposite to the first outer wall 21 having the electric wire insertion holes 27 opened and are moved forwardly, and the fit portions 33*b* are fitted to the engaged portions 29. On this occasion, the horizontal walls 32*b* of the holding portions 32 are fitted to the second outer wall 22. In this manner, the retainer 30 can be attached to the connector housing 20 smoothly by the guiding function of the second outer wall 22. Hence, the efficiency in attachment of the retainer 30 to the connector housing 20 is good.

In the aforementioned embodiments, the engaged portions 29 may be provided to continue to the front ends of the rails 28 respectively. Further, the front ends of the rails 28 per se may be provided as the engaged portions 29 respectively. The third embodiment shows an example thereof. Although a so-called positive lock type locking mechanism is provided in the aforementioned embodiments, the present invention includes an embodiment in which a so-called friction lock type locking mechanism is provided. In this case, the locking mechanism need not be provided on the second outer wall but may be provided on another portion. The present invention further includes an embodiment in which the locking mechanism is not provided.

In the insulation displacement connector including the retainer according to the first aspect of the invention, the turned-down portion of the retainer is fitted to the hood portions provided at an end of the outer wall having the electric wire insertion holes opened in the connector housing so that the contacts are pressed against the end. The connector housing is held by the holding portions which continue to opposite sides of the turned-down portion. Further, the holding portions are engaged with the connector housing against the direction of drawing-out of the contacts. Hence, the contacts can be securely prevented from becoming dislodged from the connector housing when the contacts undergo a drawing-out force or a compressive force from the electric wires. The insulation displacement connector including the retainer is adapted for a connection portion of internal wiring in a pinball machine, a vending machine, a refrigerator, or the like, which often suffers intensive draw-out force or compressive force.

According to the second aspect of the invention, the external appearance is attractive because the contacts and the insulation displacement portions are covered with the outer portion of the turned-down portion. Moreover, safety is improved because contact with a conductor can be prevented when the conductor is present in the periphery.

According to the third aspect of the invention, the engaging portions are guided by the rails so that the retainer can be attached to the connector housing smoothly. Accordingly, the efficiency in attachment of the retainer to the connector housing is good.

According to the fourth aspect of the invention, the contacts can be primarily prevented from becoming dislodged from the connector housing by the holding mechanism. Because the contacts are retained more intensively in the connector housing by the retainer, the contacts can be prevented from becoming dislodged from the connector housing even in the case where more intensive draw-out force or compass force from the electric wires is received.

While only certain embodiments of the invention have been specifically described herein, it will be apparent that numerous modifications may be made thereto without departing from the spirit and scope of the invention.

What is claimed is:

1. A retainer for an insulation displacement connector including a contact and a connector housing, the connector housing having a hood portion and a cavity for receiving the contact, said retainer comprising:

a turn-down portion formed in U shape so that a section cut by a plane facing a widthwise direction strides over the hood portion, the widthwise direction being perpendicular to a longitudinal direction of the insulation displacement connector, and said turn-down portion fit to the hood portion of the connector housing and extending in the widthwise direction so that a front end of an inner portion to be located in an inside of said hood portions presses the contact;

a pair of holding portions provided at opposite ends, in the widthwise direction, of said turn-down portion and bent respectively in an L shape and an inverted L shape when viewed from a front-rear direction, when the longitudinal direction is regarded as the front-rear direction, so as to hold opposite end portions, in the widthwise direction, of the connector housing; and a pair of engaging portions extending frontward from said holding portions respectively so as to be engaged with the connector housing.

2. The retainer for an insulation displacement connector according to claim 1, wherein an outer portion of said turn-down portion is shaped in a plate parallel to an outer wall of the connector housing, and extends frontward so as to cover an electric wire insertion holes of the connector housing.

3. The retainer for an insulation displacement connector according to claim 1, wherein each of said holding portions includes:

a vertical wall extending in a heightwise direction perpendicular to the front-rear direction; and a horizontal wall extending in the widthwise direction from an end of the vertical wall toward a vertical wall of the other holding portion, and wherein each of the engaging portions is provided on a front side of the vertical wall and includes a hook provided at a front end thereof and bent toward one of the heightwise direction and the widthwise direction.

* * * * *